US005316301A

United States Patent [19]

Boury

[11] Patent Number: 5,316,301

[45] Date of Patent: May 31, 1994

[54] STRING RACE GAME

[76] Inventor: Bradley J. Boury, 20430 Kemp, Mt. Clemens, Mich. 48043

[21] Appl. No.: 16,029

[22] Filed: Feb. 10, 1993

[51] Int. Cl.[5] ..... A63F 9/14

[52] U.S. Cl. ..... 273/86 R; 273/331; 273/344; 273/441; 273/DIG. 25; 446/228

[58] Field of Search ..... 273/86 R, 85 F, 319, 273/331, 344, 440, 441, DIG. 25; 446/228, 177, 316; 472/906

[56] References Cited

U.S. PATENT DOCUMENTS

| | | | |
|---|---|---|---|
| 849,857 | 4/1907 | Santen . | |
| 1,394,096 | 10/1921 | Lacey | 446/228 X |
| 2,124,456 | 7/1938 | Smythe . | |
| 2,469,058 | 5/1949 | Sullivan | 446/228 |
| 3,643,947 | 2/1972 | Collins | 273/86 E |
| 4,619,626 | 10/1986 | Tarulli | 446/228 |

*Primary Examiner*—V. Millin
*Assistant Examiner*—William M. Pierce
*Attorney, Agent, or Firm*—Irving M. Weiner; Joseph P. Carrier; Pamela S. Burt

[57] ABSTRACT

A game includes a plurality of sets of components, each set including a string, a mounting member stationarily attachable to a playing surface and connected to one end of the string, and a body having first and second opposed ends. The string slidably passes through an aperture formed adjacent the first end of the body. The body is formed or coated with a high friction material to engage the underlying playing surface without slippage. The second end of the string is freely supported by a player. Repeated tensioning and untensioning of the string by a player causes the body to progressively advance in a stepwise manner toward the second end of the string.

8 Claims, 2 Drawing Sheets

STRING RACE GAME

BACKGROUND OF THE INVENTION

1. Field of the Invention:

The present invention relates, in general, to games, and, specifically, to race games.

U.S. Pat. Nos. 849,857 and 2,124,456 disclose string race games in which one end of each of a plurality of spaced, generally parallel strings are fixedly attached to a support, such as an elongated bar or an upstanding end wall attached to an elongated base. The other end of each string passes through another bar or through an opposite upstanding end wall attached to the base. Elastic bands are used to attached the first end of each of the strings to the bar or the first end wall. A figure is slidably mounted on each string and is moved along the string through repeated jerks or back and forth movement of the string.

While enjoyable to play, the games disclosed in these patents require a number of different parts, such as elongated mounting bars, elastic bands or a board having a base and two upstanding end walls. This requires time consuming assembly of such games and, a game which is not easily portable.

It would be desirable to provide a string race game which is constructed of fewer components than the games disclosed in the prior art. It would also be desirable to provide a string race game which is playable on any flat surface, such as a tabletop, counter, etc. It would also be desirable to provide a string race game which is easily assembled and disassembled and, when disassembled, can be stored in a small space for convenient portability.

SUMMARY OF THE INVENTION

The present invention is a string race game playable on any flat support surface, such as a tabletop, countertop, etc. The game includes a string, each having first and second opposed ends. Means are releasably mountable in a stationary position on a support surface and attached to the first end of each string for non-movably mounting the first end of each string in a stationary position on the support surface. A body having first and second opposed ends and an aperture adjacent the first end slidably receiving the string therethrough is movable along the string. The second end of each string is spaced from the opposed first end and is freely supported by a player such that alternating back and forth movements which tension and untension the string causes a-progressive advance of the body along the string toward the second end of the string.

Preferably, the body is formed of a high friction material, such as a molded rubber or a rubber-like material. Alternately, at least the second end of each body which engages the underlying support surface is formed of or coated with a high friction material to engage the underlying surface without slippage. The body may be formed in any shape, such as a simulated animate figure.

In a preferred embodiment, the mounting means comprises a suction cup having a neck extending therefrom. The neck has a predetermined length so as to support the first end of a string attached thereto at a predetermined distance above the underlying support surface.

The string race game of the present invention is formed of a small number of individual components. The game itself is easily assemblable on any flat surface, such as a tabletop, countertop, etc. At the same time, the present string race game can be quickly and easily disassembled into a small compact size for convenient portability. While the string race game of the present invention is easy to play, it requires a higher level of skill than that required to play similar prior art string race games since a player must repeatedly apply and release tension to the free second end of the string to advance the body along the string as rapidly as possible without flipping the body backward into flat contact with the underlying support surface.

BRIEF DESCRIPTION OF THE DRAWING

The various features, advantages and other uses of the present invention will become more apparent by referring to the following detailed description and drawing in which.

DESCRIPTION OF THE PREFERRED EMBODIMENTS

Figure 1:
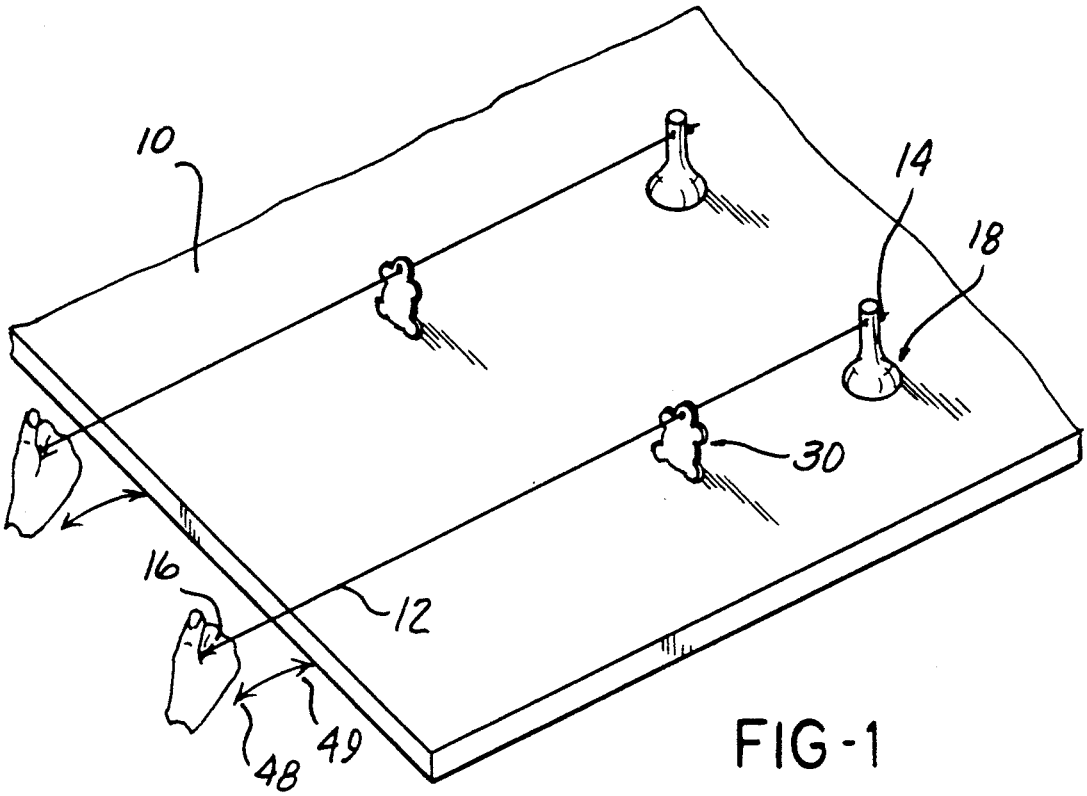
FIG. 1 is a perspective view of a string race game constructed in accordance with the teachings of the present invention.

As shown in FIG. 1, the present invention is a string race game which includes at least one and, preferably, two or more sets of identical components which are arranged side-by-side on a support surface, such as a tabletop, countertop, etc. The surface 10 is preferably flat and horizontal.

Each set of components is identical and includes an elongated member 12 which is in the form of a string, line or cord having a first end 14 and a spaced, opposed second end 16. The string 12 may be formed of any suitable material, such as cotton, although nylon is preferred for easy sliding movement of a body therealong. Each string 12 may also be provided in any length, with a three foot length being employed in an exemplary embodiment of the present invention.

Mounting means 18 is releasably mountable on the underlying support surface 10 and is designed to fixedly receive the first end 14 of one of strings 12 thereon so as to stationarily affix the first end 14 of the string 12 in a stationary position with respect to the underlying support surface 10.

Figure 4:
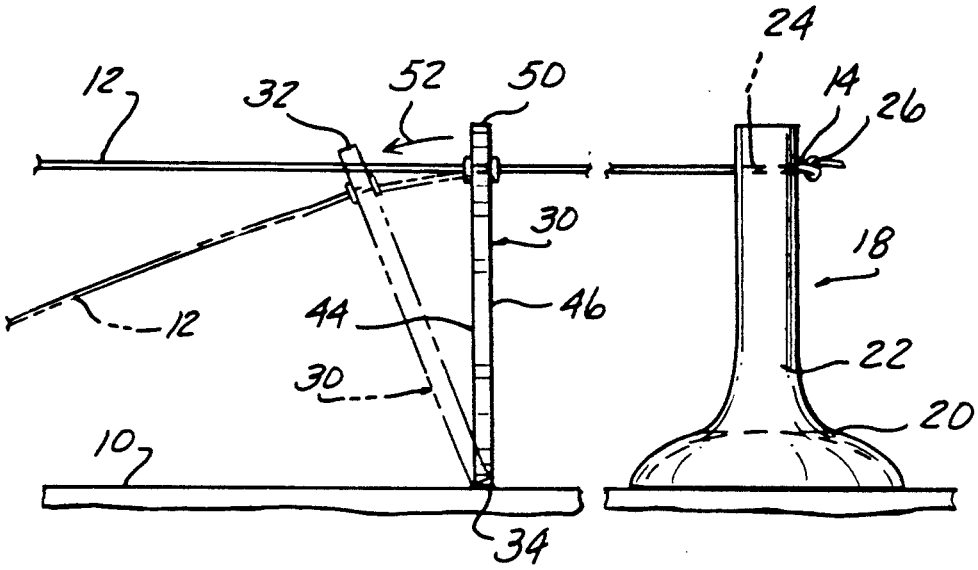
FIG. 4 is a side elevational view showing the interaction and position of the components of the string race game in one use stage.
Figure 5:
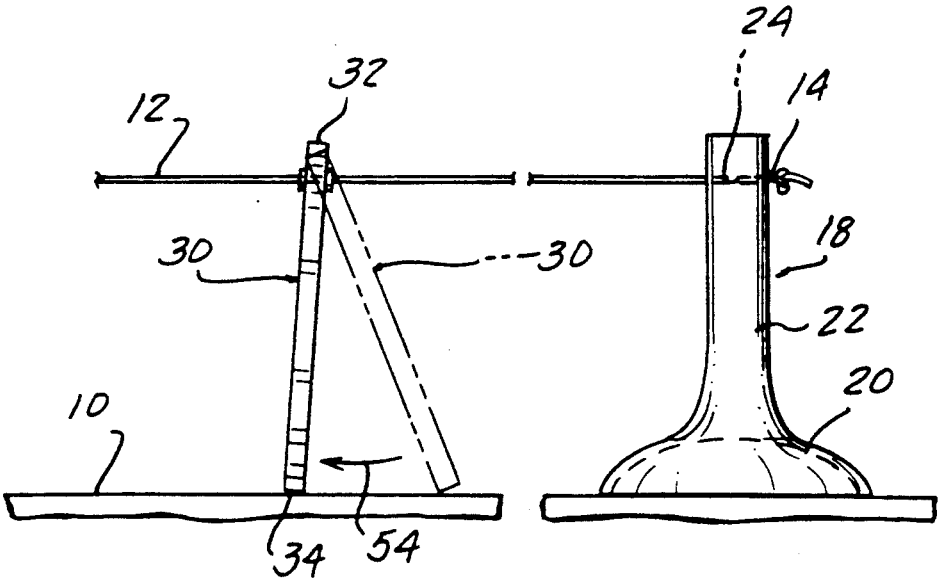
FIG. 5 is a perspective view showing the interaction and position of the components of the string race game in a subsequent use stage.

As shown more clearly in FIGS. 4 and 5, each mounting means or member 18 includes a suction cup 20 for releasable attachment to the support surface 10. An elongated neck 22 is joined to and extends from the suction cup 20 for a predetermined height. By way of example only, the neck 22 has a one inch length so as to space the first end 14 of the string 12 at a predetermined height, such as slightly more than one inch, above the underlying support surface 10. Preferably, the suction cup 20 and neck 22 are integrally formed as a one-piece member. A bore 24 is formed adjacent the outer end of the neck 22 and receives the first end 14 of the string 12 therethrough. The first end 14 of the string 12 is fixedly connected to the neck 24 by any suitable means, such as by tying the first end 14 of the string 12 in a knot 26 after passing the first end 14 of the string 12 through the bore 24 to fixedly attach the first end 14 of the string 12 to the mounting member 18.

Figure 2:
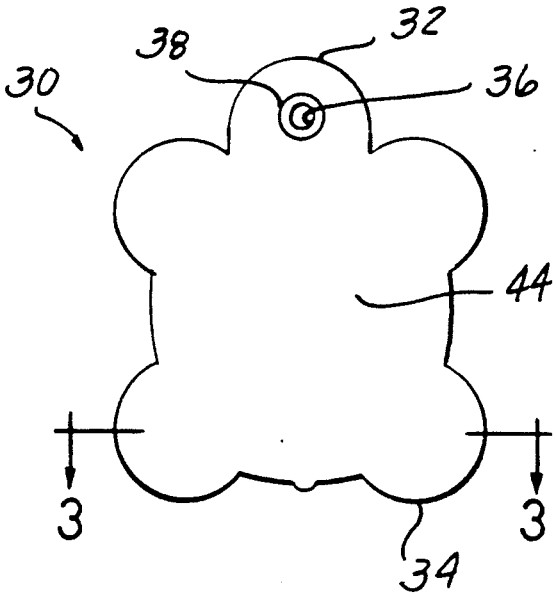
FIG. 2 is a front elevational view of a body employed in the string race game shown in FIG. 1.

A body 30 as shown in FIG. 1, and in greater detail in FIG. 2, is provided in any suitable shape or form. Preferably, the body 30 has a generally planar shape and may be formed in the shape of any character or figure, such as a simulated animate figure. By way of example only, the body 30 is shown in the design of a turtle. However, it will be understood that bodies having other shapes may also be employed in the string race game of the present invention.

The body 30 has a first end 32 and an opposed second end 34. An aperture 36 is formed in the body 30 adjacent to and spaced from the first end 32 as shown in FIG. 2. A metal grommet 38 may be optionally mounted in the aperture 36 to provide a smooth sliding surface for the string 12 which slidably passes through the aperture 36 in the body 30.

Figure 3:
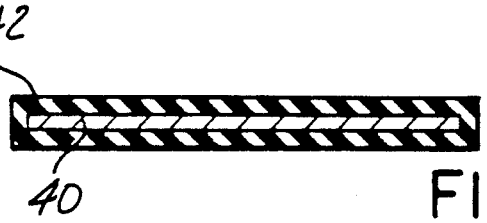
FIG. 3 is cross sectional view generally taken along line 3—3 in FIG. 2 and showing an alternate construction of the body.

The body 30 is preferably formed of a high friction material, such as a rubber or rubber-like material. By way of example only, a high friction material sold under the trademark ALCRON by Alpha Resources, Inc., Stevensville, Mich., may be employed to form the body 30. Although the entire body 30 may be molded into a desired shape from such material, in an alternate embodiment shown in FIG. 3, the body 30 may include an inner, rigid member 40 formed of any suitable material, such as wood, plastic, metal, etc. An outer coating or layer 42 of a high friction material, such as that sold under the trademark ALCRON, may be applied over at least the second end portion 34 of the body 30. Of course, the entire inner member 40 may be coated with a layer 42 of a high friction material. The high friction material is designed to provide secure, non-slipping engagement between the second end 34 of the body 30 and the underlying support surface 10 to enable the body 30 to easily advance along the string 12 and the support surface 10 as described hereafter.

In assembling the string race game of the present invention, a plurality of the mounting members 18 are fixedly placed in a desired location on the support surface 10 in a coplanar, spaced arrangement as shown in FIG. 1. One string 12 is then attached to each mounting member 18 by tying or other means, as described above. A body 30 is then slidably mounted onto each string 12 by passing the string 12 through the aperture 36 in each body 30. Each body 30 is moved along the string 12 into close proximity with the mounting member 18 for the start of the play of the game. As shown in FIG. 1, the second end 16 of each string 12 is grasped by a player and held a short distance above the support surface 10.

At the start of play of the string race game of the present invention, each body 30 will typically be in flat contact with the underlying support surface 10 with a front surface 44 of each body 30 disposed in contact with the underlying support surface 10. The string 12 associated with each body 30, at this time, is held loosely or without tension by a player. To start the game, each player grasps the second end 16 of a string 12 and applies tension thereto by pulling the second end 16 of the string 12 away from the mounting member 18 in the direction of the arrow 48 in FIG. 1. This applies tension to the string 12 and causes the first end 32 of the body 30 mounted thereon to pivot upward about the second end 34 to a substantially vertical position, shown in solid by reference number 50 in FIG. 4. During such pivotal movement, the second end 34 of the body 30 remains in non-movable frictional contact with the support surface 10.

Each player then repeatedly and sequentially releases and applies tension to his or her string 12 by alternatingly moving the second end 16 of the string 12 in the direction of the arrows 48 and 49 in FIG. 1. During the first untensioning of the string 12, as shown in FIG. 4, each body 30 to move from a generally vertical position shown in solid in FIG. 4 by reference number 50 to a forward angled position shown in phantom in FIG. 4 toward the second end of the string 12 in which the first end 32 of the body 30 is disposed at an acute angle with respect to the support surface 10. This movement in the direction of arrow 52 in FIG. 4 is achieved by releasing tension on the string 12 which loosens the string 12. The body 30 thereby pivots about the second end 34 which remains in frictional contact with the support surface 10.

Next, as shown in FIG. 5, a player will apply tension to the string 12 by pulling the second end 16 of the string 12 in a direction away from the mounting member 18 until the string 12 is tight or fully extended. This generally straightens the string 12 as shown in FIG. 5 and causes the second end 34 of the body 30 to slide forward in the direction of arrow 54 in FIG. 5 along the support surface 10 until the body 30 is substantially vertical or the second end 34 of the body 30 is disposed slightly ahead of the first end 32. The skill of the player will determine how far the second end 34 of the body 30 will advance during each tensioning on the string 12.

This process is repeated at a rapid pace, depending upon the skill of the player, to sequentially advance each body 30 along its associated string 12 in a stepwise manner from the first end 14 to the second end 16 of the string 12.

Skill is required on the part of the player to advance the body 30 quickly toward the second end 16 of the string 12, with the first body 30 reaching a predetermined finish line, such as the edge of the support surface 10, being the winner of the race. Each player must repeatedly tension and untension the string 12 while maintaining the second end 34 of the body 30 in engagement with the support surface 10. Each player must also position the string 12, when tensioned, in a generally parallel line with the support surface 10 to prevent the body 30 from flipping over onto a back surface 46 which, if brought into contact with the support surface 10 results, according to the rules of play of the string race game of the present invention, in an automatic loss of the game. Further, it is difficult or at least time consuming to raise a body 30 which is disposed with its back surface 46 in flat contact with the support surface 10 back to a vertical position to again advance the body 30 toward the second end of the string 12.

It will be noted that the high frictional material employed on the body 30 will retain the body 30 in a sequentially advanced position shown in phantom in FIG. 4 during the untensioning of the string 12 and prevent the body 30 from slipping about the second end 34 which would bring the front surface 44 of the body 30 into contact with the support surface 10. The high frictional material forming or coating the body 30 ensures that the body 30 is capable of sequentially advancing along the length of the string 12 in the above-described manner.

In summary, there has been disclosed a unique string race game which is formed of a minimal number of components for a low manufacturing cost, easy assembly and disassembly and ease of play. The game may be disassembled into separate components which can be packaged in a small compact shape for easy portability and storage. At the same time, the string race game of the present invention requires a certain level of skill to sequentially and quickly advance a body along the length of the string. The string race game may be played alone by a single player for enjoyment or practice, or it may be played as a race with a plurality of players, each moving a body along his or her own string.

What is claimed is:

1. A game comprising:

a string having first and second opposed ends;

a suction cup releasibly and stationarily mounted at a first end on a surface and a neck of a predetermined length joined to and extending from the suction cup;

a bore formed in the neck and receiving the first end of the string therethrough;

means for attaching the first end of the string through the bore to the neck;

a body having first and second opposed ends, an aperture formed in the body adjacent the first end thereof and slidably receiving the string therethrough, the body having a high friction surface formed on at least the second end thereof;

the bore in the neck being spaced an identical distance from the first end of the suction cup as the distance of the aperture in the body from the second end of the body; and the second end of the string being spaced from the first end of the string over a surface and freely supported by a player such that alternating tensioning and untension of the second end of the string from the first end to the second end of the string as long as the second end of the string is not raised above the first end of the string.

2. The game of claim 1 further comprising:

a grommet mounted in the aperture in the body and slidably receiving the string therethrough.

3. The game of claim 1 wherein the body has a high friction surface formed on at least the second end thereof.

4. The game of claim 1 wherein the body comprises:

an inner material layer; and an exterior material layer having a higher coefficient of friction than the inner layer disposed over at least the second end of the body.

5. The game of claim 1 wherein the body is planar.

6. The game of claim 1 wherein the body is formed in the shape of the an animate figure.

7. The game of claim 1 wherein:

the body has an exterior high friction material layer formed over the entire exterior surface thereof.

8. The game of claim 7 wherein:

the body is formed of a material having a high coefficient of friction.

* * * * *

UNITED STATES PATENT AND TRADEMARK OFFICE

CERTIFICATE OF CORRECTION

PATENT NO. : 5,316,301
DATED : May 31, 1994
INVENTOR(S) : Bradley J. Boury

It is certified that error appears in the above-indentified patent and that said Letters Patent is hereby corrected as shown below:

Column 1, line 51, delete the "-" after "a".

Column 6, line 8 (claim 1, line 23), change "untension" to --untensioning--; after "string" insert --causes a progressive advance of the body along the string--.

Signed and Sealed this

Twenty-third Day of August, 1994

*Attest:*

*Attesting Officer*

BRUCE LEHMAN

*Commissioner of Patents and Trademarks*